US005230199A

United States Patent [19]

Yee

[11] Patent Number: 5,230,199

[45] Date of Patent: Jul. 27, 1993

[54] SPLICE SLEEVE FOR CONNECTING REINFORCING BARS TO ANOTHER ENTITY

[75] Inventor: Alfred A. Yee, Honolulu, Hi.

[73] Assignee: Splice Sleeve Japan, Ltd., Tokyo, Japan; part interest

[21] Appl. No.: 885,200

[22] Filed: May 19, 1992

[51] Int. Cl.[5] ..... E04C 3/30

[52] U.S. Cl. ..... 52/728; 52/726.1; 403/305; 403/301

[58] Field of Search ..... 52/728, 726, 227, 230; 403/301, 305, 268

[56] References Cited

U.S. PATENT DOCUMENTS

| | | | |
|---|---|---|---|
| 3,540,763 | 11/1970 | Yee | 287/108 |
| 3,552,787 | 1/1971 | Yee | 287/108 |
| 3,850,535 | 11/1974 | Howlett | 403/305 |
| 4,627,212 | 12/1986 | Yee . | |
| 5,067,844 | 11/1991 | Bowmer | 403/305 |

*Primary Examiner*—Carl D. Friedman

*Assistant Examiner*—Creighton Smith

*Attorney, Agent, or Firm*—Jacobson, Price, Holman & Stern

[57] ABSTRACT

A splice sleeve for connecting reinforcing bars in a concrete structure or the like to another entity with the sleeve being rigidly affixed to the reinforcing bar and provided with an anchor structure for anchoring the sleeve to another entity. In one embodiment, the sleeve is frustro-conical and provided with internal rings of equal height having an inner diameter which decreases toward the outer end. In another embodiment, the sleeve is cylindrical with internal rings of unequal height which have an inner diameter that decrease toward the end of the sleeve receiving the reinforcing bar. Hardenable grouting is used between the sleeve and reinforcing bar to positively lock the reinforcing bar, grouting and sleeve together thereby providing a rigid connection between the concrete structure in which the reinforcing bar is incorporated as well as the sleeve and associated anchor structure to another entity.

9 Claims, 1 Drawing Sheet

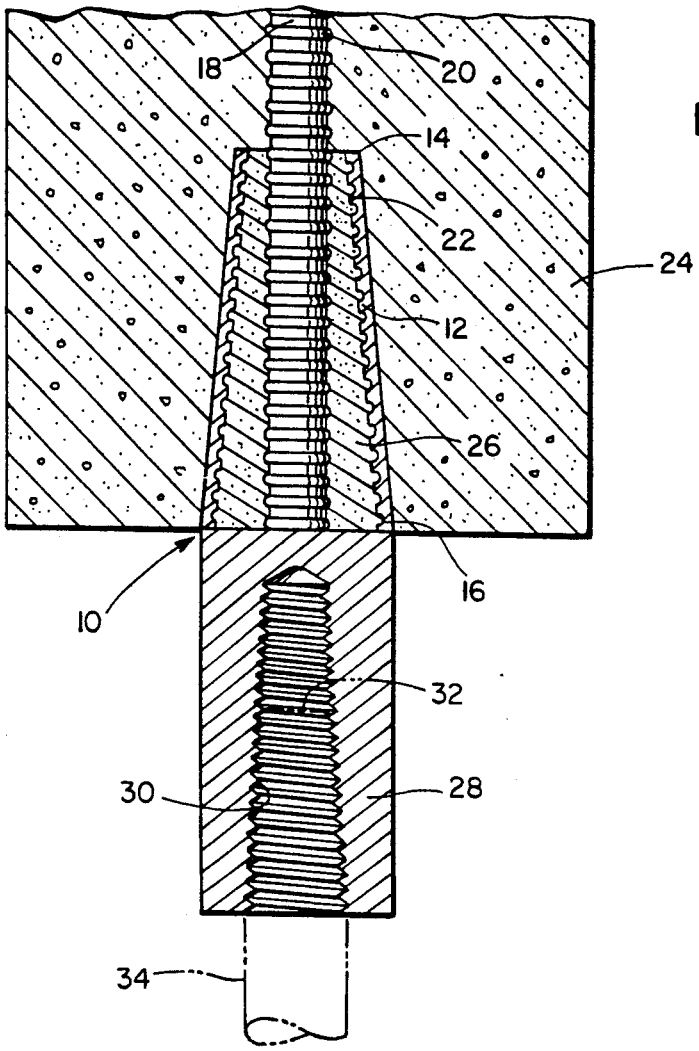
FIG. 1
FIG. 2
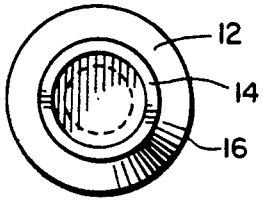
FIG. 4
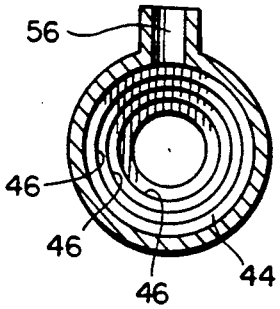
FIG. 3
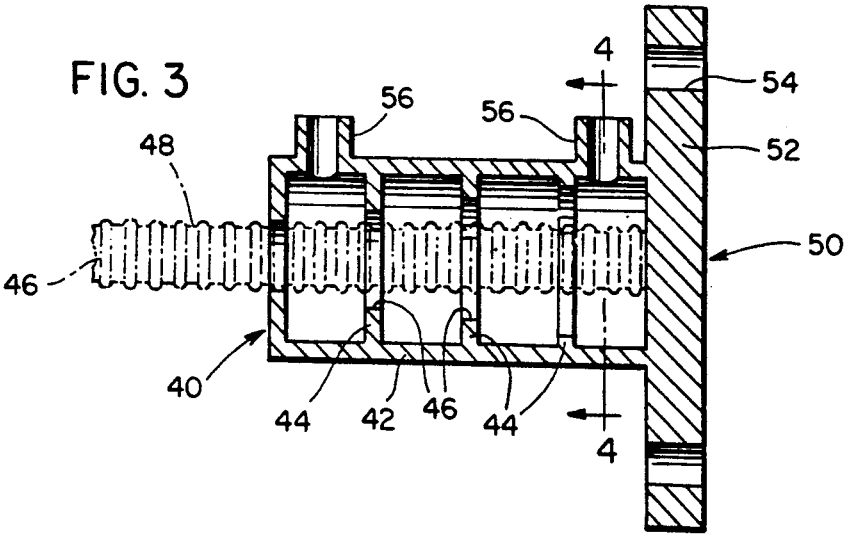

SPLICE SLEEVE FOR CONNECTING REINFORCING BARS TO ANOTHER ENTITY

BACKGROUND OF THE INVENTION

1. Field of the Invention

This invention relates to a splice sleeve for connecting reinforcing bars utilized in various concrete structures to another entity such as a supporting structure or the like. The splice sleeve includes in one embodiment a frustro-conical sleeve having a plurality of annular rings of equal radial height extending circumferentially on the inner surface thereof in longitudinally spaced relation with the internal circumference of the rings decreasing toward the outer end of the sleeve with grouting filling the area between the reinforcing bar and the rings on the sleeve for interlocking the reinforcing bar with the sleeve. The larger end of the frustro-conical sleeve is provided with a mechanical anchor structure for connection with another entity with on embodiment of the anchor structure including an internal threaded cavity in which the threads taper inwardly from the outer end of the cavity.

In another embodiment of the splice sleeve, the sleeve includes a generally cylindrical shell having internal rings of unequal radial height on the inner surface thereof in longitudinally spaced relation to each other with the internal diameter of the rings decreasing toward the outer end of the sleeve with the space between the sleeve and reinforcing bar being filled with grouting to interlock the sleeve and reinforcing bar. The other end of the sleeve is provided with a mechanical anchor structure in the form of an inwardly tapering threaded cavity communicating with the other end of the sleeve. Either embodiment of the splice sleeve may have an anchor structure in the form of a rigid plate integral with or attached to the sleeve by which the splice sleeve can be connected to a supporting structure or other entity with the mechanical anchoring structures serving to connect a reinforcing bar and a concrete structure in which the reinforcing bar may be incorporated to another entity with both embodiments of the invention including a sleeve having annular rings on the interior surface thereof in which the effective inside diameter of the rings decreases toward the outer end of the sleeve to provide a rigid connection between the sleeve and the reinforcing bar and between the sleeve and another entity.

2. Description of the Prior Art

My prior U.S. Pat. No. 3,540,763 issued Nov. 17, 1970 discloses a splice sleeve of double frustro-conical configuration used for connecting aligned reinforcing bars which are inserted from opposite ends of the sleeve with the space between the sleeve and reinforcing bars being filled with grouting. My prior U.S. Pat. Nos. 3,552,787 and 4,627,212 also disclose splice sleeves with U.S. Pat. No. 4,627,212 disclosing various splice sleeve configurations in which the interior surface is provided with a plurality of circumferential rings having decreasing internal diameters toward the outer ends of the sleeve for connecting aligned reinforcing bars.

The prior art cited in my above mentioned prior patents is incorporated herein by reference thereto.

None of the prior patents disclose the combination of a splice sleeve in the form of a shell having internal circumferential rings in which the internal diameter of the rings effectively decreases toward the outer end of the sleeve combined with an anchor structure which connects the sleeve to another entity with the anchor structure being integral with or rigidly affixed to the end of the sleeve having the larger internal diameter rings associated therewith with the space between the shell of the sleeve and the reinforcing bar being filled with grouting which hardens thus forming a rigid and secure connection between the reinforcing bar, grouting, sleeve and anchor structure thus supporting or anchoring a concrete structure in which the reinforcing bar may be incorporated to the entity which may be in the form of a supporting base or other supporting structure or any other entity to which it is desired to connect reinforcing bars in a secure manner.

SUMMARY OF THE INVENTION

An object of the present invention is to provide a splice sleeve for securely and rigidly connecting a reinforcing bar to another entity thereby connecting a concrete structure in which the reinforcing bar is incorporated to the entity with the sleeve including an anchor structure at one end thereof with the sleeve also including a shell telescopically receiving an end portion of a reinforcing bar with the shell including a plurality of annular rings of equal or unequal radial height in which the inner diameter of the annular rings decreases sequentially toward the outer end of the shell for receiving hardenable grouting to securely and rigidly anchor the reinforcing bar to the splice sleeve when the grouting hardens thereby enabling the anchor structure to secure the splice sleeve and reinforcing bar together with any concrete structure in which the reinforcing bar is incorporated to the entity.

Another object of the invention is to provide a splice sleeve in accordance with the preceding object in which the shell is frustro-conical in configuration with all of the rings being of the same radial extent with the internal diameter of the rings extending radially inwardly an equal distance from the shell throughout the frustro-conical extent of the shell whereby the rings decrease in internal diameter toward the outer end of the shell.

A further object of the invention is to provide a splice sleeve including a shell of generally cylindrical configuration and provided with internal rings which increase in radial extent and decrease in internal diameter toward the outer end of the shell.

Still another object of the invention is to provide a splice sleeve in accordance with the preceding objects in which the anchor structure is in the form of a longitudinal, internally threaded bore at the end of the sleeve opposite to that which receives the reinforcing bar with the internal thread tapering inwardly for threaded engagement with a correspondingly shaped anchor structure.

A still further object of the invention is to provide a splice sleeve in accordance with the preceding objects in which the anchor structure is a support or mounting plate rigid with the end of the sleeve opposite to that which receives the reinforcing bar with the plate being rigid with the sleeve and adapted to be connected to a supporting structure or other entity.

These together with other objects and advantages which will become subsequently apparent reside in the details of construction and operation as more fully hereinafter described and claimed, reference being had to the accompanying drawings forming a part hereof, wherein like numerals refer to like parts through-out.

BRIEF DESCRIPTION OF THE DRAWINGS

FIG. 1 is a longitudinal, sectional view of the embodiment of the splice sleeve in which the sleeve includes a shell of frustro-conical configuration and internal rings having a decreasing inner diameter toward the outer end of the shell.

FIG. 2 is an end view of the construction of FIG. 1.

FIG. 3 is a longitudinal, sectional view illustrating an embodiment of the splice sleeve in which the shell is substantially cylindrical with the radial extent of the internal rings increasing toward the outer end of the shell thereby providing a decreasing internal diameter to the annular rings toward the outer end of the shell.

FIG. 4 is an end view of the construction of FIG. 3.

DESCRIPTION OF THE PREFERRED EMBODIMENTS

Referring now specifically to FIGS. 1 and 2, the splice sleeve illustrated therein is generally designated by reference numeral 10 and includes a shell 12 of one piece construction which is frustro-conical in configuration and includes a smaller diameter outer end 14 and a larger diameter inner end 16 for receiving an end of a reinforcing bar 18 which is of conventional construction and may include peripheral ribs 20 thereon. The interior surface of the frustro-conical shell 12 includes a plurality of annular rings 22 formed integrally therewith in which the radial extent of each of the rings is equal but due to the conical configuration of the shell, the internal diameter of the rings 22 decreases toward the outer end of the shell 12. As illustrated, the frustro-conical sleeve 12 is embedded in a concrete structure 24 with the reinforcing bar 18 also being embedded in the concrete structure. The annular space between the shell 12 and the reinforcing bar 18 is filled with hardenable grouting 26 which hardens in rigid relation to the ribs 20 on the reinforcing bar 18 and the rings 22 on the interior of the shell 12. As illustrated, the space which is filled by the grouting 26 is generally wedge-shaped due to the configuration of the shell 12 and the rings 22 thereon thus securely locking the reinforcing bar 18 and splice sleeve 10 to each other when the hardenable grouting 26 hardens in a manner which results in a structure similar to one-half of the sleeve disclosed in my U.S. Pat. No. 3,540,763.

The end of the frustro-conical shell 12 remote from the outer end which receives the reinforcing bar 18 is provided with an anchor structure 28 in the form of an internally threaded recess or bore 30 extending inwardly from the end of the shell 12 with the internal threads 30 tapering inwardly from the outer end of the shell 12 to receive the correspondingly shaped threaded end 32 of an anchor rod, bolt or the like 34 by which the splice sleeve can be anchored to an entity to which the reinforcing bar 18 or concrete structure 24 is to be connected. By using one-half of the double frustro-conical sleeve illustrated in my U.S. Pat. No. 3,540,763 and combining it with the anchor structure 28, the sleeve, reinforcing bar and concrete structure associated therewith can be securely retained in a desired, anchored position.

FIGS. 3 and 4 illustrate another embodiment of the splice sleeve designated by reference numeral 40 and which includes a generally cylindrical sleeve or shell 42 having a plurality of circumferentially extending, longitudinally spaced internal rings 44 in which the radial extent of rings 44 increases so that the internal diameter 46 of rings 44 decreases toward the outer end of the shell 42 which telescopically receives a reinforcing bar 46 therein in which the reinforcing bar includes a plurality of external ribs 48 that are associated with the decreasing diameter rings 44 to anchor the reinforcing bar 46 to the sleeve 40. This structure is quite similar to one-half of the sleeve illustrated in my U.S. Pat. No. 4,627,212 and the decreasing diameter of the internal rings toward the outer end of the sleeve provides a wedging action so that hardenable grouting filling the space between the sleeve and the reinforcing bar will rigidly secure the reinforcing bar to the sleeve due to the wedging action between the reinforcing bar, grouting and sleeve.

The other end of the sleeve 40 is provided with an anchor structure 50 which may serve the same purpose as the anchor structure 28 in FIG. 1 and may be exactly the same structure as the anchor structure 28. The embodiment of the anchor structure 50 as illustrated in FIG. 3 is in the form of a mounting or support plate or bar 52 rigidly affixed to and perpendicular to the end of the shell 42 by welding or the plate 52 may be integral with the shell. Mounting holes 54 are provided in plate 52 by which the plate can be anchored to a supporting structure, lifting structure or any other entity to which the sleeve and reinforcing bar is to be connected with the sleeve and reinforcing bar being embedded in a concrete structure thus enabling the concrete structure to be anchored to the entity by use of the mounting or support plate. Either embodiment of the splice sleeve may be anchored with either of the anchor structures. Also, the splice sleeves may be provided with grouting ports 56 by which grouting can be inserted into the space between the sleeve and reinforcing bar through one port while air escapes from the other port with the grouting ports being optional and not necessary when the splice sleeve is vertically oriented since the grouting ca then usually be placed into the space between the sleeve and reinforcing bar by using a suitable discharge nozzle for gravity flow between the reinforcing bar and splice sleeve.

Essentially, the present invention involves the combination of the wedging configuration and the positive locking engagement between the splice sleeve, the grouting and reinforcing bar as described in more detail in U.S. Pat. No. 4,627,212 combined with an anchor structure for anchoring the splice sleeve and associated structure to another entity by using an internally threaded cavity or externally threaded member in which the threads may be tapered, a mounting plate, bar or other anchoring device in which the splice sleeve is, in effect, one-half of splice sleeve shown in my prior patents.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A sleeve for connecting a reinforcing bar to another entity comprising an elongated hollow shell having an open end telescopically receiving an end portion of a concrete reinforcing bar, the interior of said shell including a plurality of circumferentially extending, longitudinally spaced rings projecting inwardly from the inner surface of the shell, each of said rings having an inner diameter with the inner diameters decreasing in dimension toward the end of the shell receiving the end of the reinforcing bar therein, hardenable grouting filling space between the end portion of the reinforcing bar and the interior of said shell to provide a positive interlocking connection between the reinforcing bar and shell, the end of said shell opposite to that receiving said reinforcing bar including an anchor structure by which the shell can be attached to another entity thereby connecting the reinforcing bar to said another entity, said anchor structure including a plate oriented perpendicular to said sleeve, extending beyond the sleeve and being rigid with the sleeve, said plate including mounting holes by which the plate can be attached to another entity thereby connecting the reinforcing bar to another entity.

2. The sleeve as defined in claim 1 wherein said shell includes a cylindrical internal surface, said rings having an inward radial extent increasing equally or unequally toward the end of the shell which receives the reinforcing bar thereby providing a decreasing inner diameter to the rings which progressively reduces toward the end of the shell receiving the reinforcing bar.

3. The sleeve as defined in claim 1 wherein said shell tapers smoothly from a larger diameter end to a smaller diameter end with the reinforcing bar received in the smaller end of the shell, all of said rings on the interior of the shell being of equal or unequal height with the inner diameters of the rings tapering in a manner corresponding to the angle of taper of the shell.

4. A connector for connecting a concrete structure to another entity in which the concrete structure includes reinforcing bars, a splice sleeve connected with and rigidly affixed to an end portion of a reinforcing bar to rigidly connect the splice sleeve to the concrete structure and means on the splice sleeve anchoring the splice sleeve to another entity thereby connecting the concrete structure to said another entity, said splice sleeve including an elongated shell having a hollow interior with the interior surface of the shell including a plurality of radially inwardly extending peripheral rings disposed in longitudinally spaced relation, said rings having an inner diameter which sequentially decreases from rings with a larger inner diameter at the inner end of the internal surface on the shell to rings with a smaller inner diameter at an outer end of the shell, hardenable grouting in a space between the shell and reinforcing bar to positively lock the reinforcing bar, grouting and shell together, the end of the shell opposite to that receiving the reinforcing bar including an anchor structure for connecting the shell to another entity thereby connecting the reinforcing bar and concrete structure to another entity, said anchor structure including a threaded area extending longitudinally inwardly from the end of the shell remote from the end of the shell which receives the reinforcing bar, said threaded area being unitary with said shell to provide direct threaded contact between said shell and said threaded anchor device.

5. The connector as defined in claim 4 wherein said threaded area includes an internally threaded cavity terminating in a closed inner end to isolate said threaded cavity from said grouting, said anchor device including external threads, said internal threads in the cavity and the external threads on the anchor device tapering inwardly to a smaller diameter.

6. The sleeve as defined in claim 5 wherein said shell tapers smoothly from a larger diameter end to a smaller diameter end with the reinforcing bar received in the smaller end of the shell, all of said rings on the interior of the shell being of equal or unequal height with the inner diameters of the rings tapering in a manner corresponding to the angle of taper of the shell.

7. The connector as defined in claim 4 wherein all of said rings have an equal radial height.

8. The connector as defined in claim 4 wherein all of said rings have an unequal radial height.

9. A sleeve for connecting a reinforcing bar to another entity comprising an elongated hollow shell having an open end telescopically receiving an end portion of a concrete reinforcing bar, the interior of said shell including a plurality of circumferentially extending, longitudinally spaced rings projecting inwardly from the inner surface of the shell, each of said rings having an inner diameter with the inner diameters decreasing in dimension toward the end of the shell receiving the end of the reinforcing bar therein, hardenable grouting filling space between the end portion of the reinforcing bar and the interior of said shell to provide a positive interlocking connection between the reinforcing bar and shell, the end of said shell opposite to that receiving said reinforcing bar including an anchor structure by which the shell can be attached to another entity thereby connecting the reinforcing bar to said another entity, said anchor structure including a plate oriented transversely of said sleeve, and being rigid with the sleeve, said plate including mounting means by which the plate can be attached to said another entity thereby connecting the reinforcing bar to said another entity.

* * * * *